US005586566A

United States Patent [19]

Kim et al.

[11] Patent Number: 5,586,566

[45] Date of Patent: Dec. 24, 1996

[54] ZIG-ZAG METHOD OF BRAIDING HAIR

[76] Inventors: Ryeu K. Kim, 21100 Nashville St., Chatsworth, Calif. 91311; Im S. Lee, #371-4 Geolpo-Ri, Kimpo-Up, Kimpo-Gon, Kyunggi-Do, Rep. of Korea

[21] Appl. No.: 508,706

[22] Filed: Jul. 28, 1995

[51] Int. Cl.[6] ..... A45D 24/00

[52] U.S. Cl. ..... 132/200; 132/201; 132/53; 132/56

[58] Field of Search ..... 132/201, 200, 132/56, 53

[56] References Cited

U.S. PATENT DOCUMENTS 1,199,144 9/1916 Zak ..... 132/56

4,016,889 4/1977 Cowles ..... 132/56

5,413,124 5/1995 Incanbo ..... 132/56

*Primary Examiner*—Cary E. O'Connor

*Assistant Examiner*—Pedro Philogene

*Attorney, Agent, or Firm*—Eugene Oak, Ph.D., J.D.

[57] ABSTRACT

A zig-zag method of braiding hair which is applied to the production of braided wigs and hair pieces. The method suggests three specific and essential steps to producing two identical hair pieces. The first step is to arrange a single lock of braided hair in a zig-zag orientation. The second step is to affix a pair of bases, one on each side of the zig-zag oriented lock of hair, and the third step is to make an incision down the middle of the zig-zag equidistant from each side of the of the ends of the zig-zags, resulting in two identical hair pieces. The hair that is used in this process can either be real hair, synthetic hair, or a mixture of both.

1 Claim, 2 Drawing Sheets

ZIG-ZAG METHOD OF BRAIDING HAIR

BACKGROUND OF THE INVENTION

1. Field of the Invention

The present invention generally relates to an innovative method applied to braiding large quantities of hair or synthetic hair, which are generally used to manufacture wigs. The new method reduces labor costs by braiding the hair or synthetic hair by machines, thus allowing the production of the braided wigs to be more efficient.

2. Description of the Prior Art

Wigs are often used to enhance one's appearance or bring variety to one's image. Wigs with braided hair are especially popular in that they allow the owner to project a certain "look", while having the convenience that all wigs inherently provide. Prior to the present invention, the production of braided wigs has been a toilsome and time-consuming task. Workers have had to attach hair or synthetic hair to a base, and then proceed to hand braid ridiculous amounts of hair. Not only has this process been extremely time consuming, it has also been extremely costly to manufacturers.

Therefore, the principle object of the present invention is to provide a more efficient method of braiding hair or synthetic hair that is to be used in wigs.

It is another object of the present invention to provide a method of braiding hair that is expedient and relatively inexpensive.

It is a further object of the present invention to reduce the amount of human labor needed by using machines instead.

SUMMARY OF THE INVENTION

The present invention is a method of braiding hair or synthetic hair. The conventional method of braiding hair is to braid a plurality of locks of hair and then attach them to a base. However, the present invention provides for the braiding of one extremely long lock of hair. This long braided lock of hair is then arranged in a zig-zag orientation, where the junctures in which the long braided lock of hair turn to the opposite direction ("U-turns") on both sides of the center of the zig-zag orientation are arranged in an imaginary straight line. A base is then attached to the "U-turns" along the imaginary straight line, one base along each side, and the lock is then cut down the middle of the zig-zag. This results in two equal bases having a plurality of locks of braided hair uniformly attached to each one of them.

This principle method together with other objects of the invention are discussed in more detail in the claim annexed to and forming a part of this disclosure. For a better understanding of the invention, its operating advantages and the specific objects attained by its use, reference should be made to the accompanying drawings and descriptive matter in which there are illustrated the preferred embodiments of the invention.

BRIEF DESCRIPTION OF THE DRAWINGS

For a better understanding of the principle and nature of the present invention, references should be made to the following detailed description taken in connection with the accompanying drawings in which.

DETAILED DESCRIPTION OF THE PREFERRED EMBODIMENT

Figure 1:
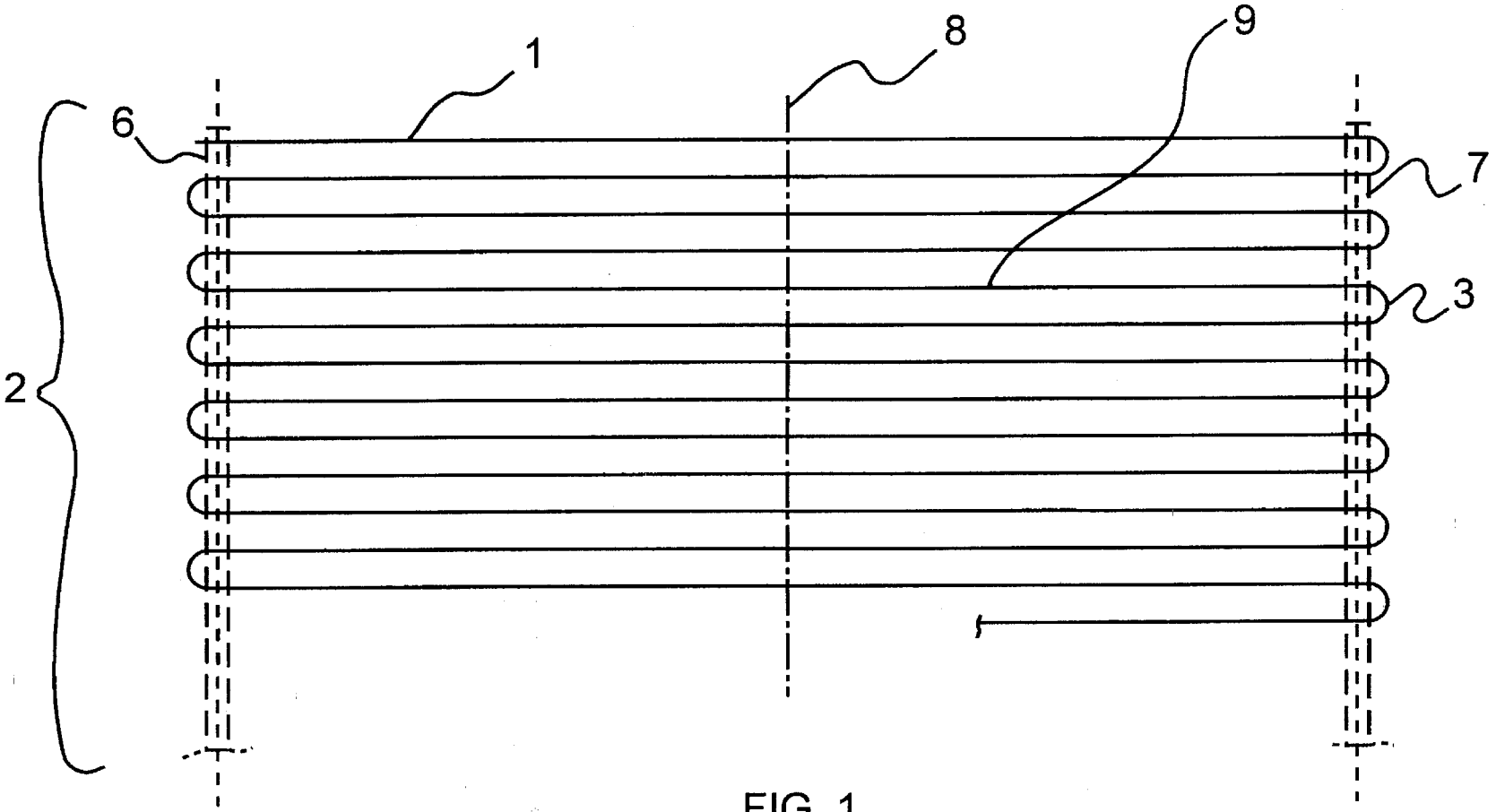
FIG. 1 is an over-all view of the zig-zag method of braiding hair, explicitly showing the zig-zag orientation and the pair of bases.
Figure 2:
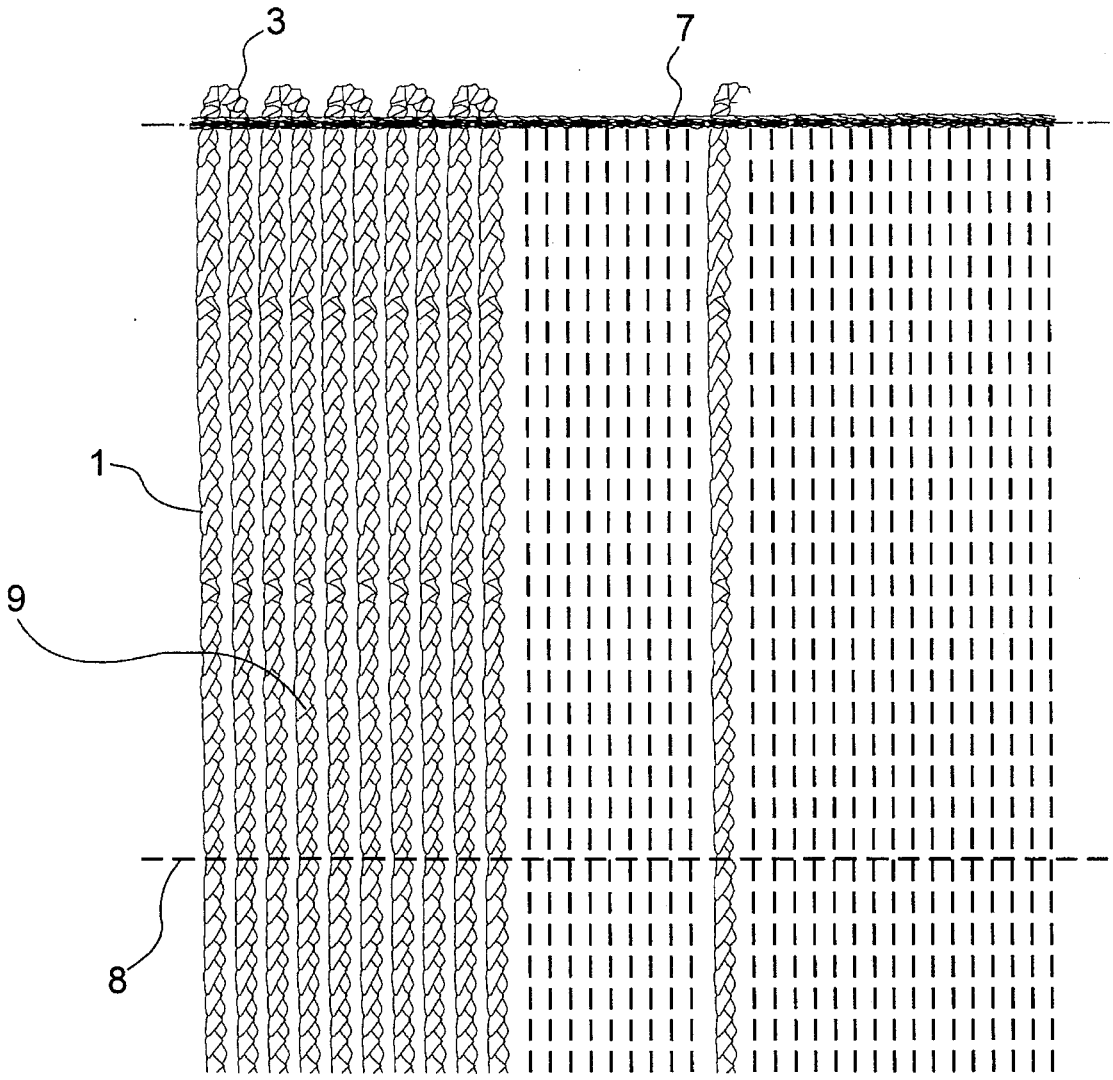
FIG. 2 is an over-all view of one of the two identical hair pieces that result from the zig-zag method of braiding hair.

Referring to FIG. 1, the Zig-Zag Method for Braiding Hair comprises a long braided lock of hair 1 that is arranged in a zig-zag orientation 2. The junctures in which the long braided lock of hair 1 turns to to the opposite direction are called folds 3. The plurality of sections of hair between each pair of consecutive folds 3 are called segments 9. A pair of bases 6 and 7 are affixed to the folds 3 when the folds 3 are uniformly arranged and the segments 9 are equidistant from, parallel to, and equal in length to one another. An incision 8 is made down the middle of the plurality of segments, thus resulting in two identical hair pieces. Referring to FIG. 2, one such hair piece is depicted, with the relevant parts being labelled.

Although the previous description of the present invention depicts a particular embodiment, the intention of the detailed description is to describe the preferred embodiment of the present invention, and not to limit the possible embodiments of the invention. Thus it should be noted that the present invention can assume several alternate embodiments, and a liberal interpretation of the present invention is thus requested.

IN THE CLAIM:

What is claimed as being new and therefore desired to be protected by letter patent of the United States is as follows:

1. A zig-zag method of braiding hair comprising a long braided lock of hair, folding said long braided lock of hair a plurality of times, wherein a resulting plurality of folds are equidistantly arranged forming a plurality of segments of said long braided lock of hair between each consecutive pair of said folds, said plurality of segments of said long braided lock of hair being parallel to one another, equidistantly arranged, and equal in length to one another, affixing a base transversely across said plurality of folds in which said folds are firmly attached to said base, and transversely cutting said plurality of segments through middle of said plurality of segments, thus resulting in two identical hair pieces.

* * * * *